United States Patent [19]

Donohoe

[11] 4,319,514

[45] Mar. 16, 1982

[54] CYMBAL-MOUNTING DEVICE

[75] Inventor: David G. Donohoe, Corona, Calif.

[73] Assignee: Aquarian Coatings Corp., Tustin, Calif.

[21] Appl. No.: 156,046

[22] Filed: Jun. 2, 1980

[51] Int. Cl.[3] ..... G10D 13/06

[52] U.S. Cl. ..... 84/421

[58] Field of Search ..... 84/421, 422 C

[56] References Cited

U.S. PATENT DOCUMENTS

| | | | |
|---|---|---|---|
| 3,893,363 | 7/1975 | Cohen | 84/421 |
| 3,994,198 | 11/1976 | Herman | 84/421 |
| 4,122,750 | 10/1978 | Rinker | 84/421 |
| 4,200,024 | 4/1980 | Watson | 84/421 |
| 4,216,695 | 8/1980 | Hoshino | 84/421 |

OTHER PUBLICATIONS

Music Trades, Oct. 11, 1913, p. 46.

*Primary Examiner*—L. T. Hix
*Assistant Examiner*—Alan Mathews
*Attorney, Agent, or Firm*—Francis X. LoJacono

[57] ABSTRACT

A unique mounting device for a cymbal providing a quick-release arrangement. The mounting device, adapted to be secured to the free end of a cymbal stand, includes a bushing mount that is positioned on and secured to the stand, the bushing mount being adapted to receive a flexible cymbal restraint, wherein a keeper member is formed as an integral part thereof to allow the cymbal to be snapped on and off. Mounted to the restraint below the keeper member is a cymbal-support bracket having a felt pad, whereby the cymbal is held in position between the keeper member and the pad to provide positive angular positioning of the attached cymbal, and yet allow the spring to geniculate when necessary.

13 Claims, 6 Drawing Figures

CYMBAL-MOUNTING DEVICE

BACKGROUND OF THE INVENTION

1. Field of the Invention

This invention relates to cymbal-mounting devices, and more particularly to a mounting device that includes a flexible restraint having a quick-release member.

2. Description of the Prior Art

It is well known in the art that several problems and difficulties are encountered in providing suitable means for mounting cymbals to various types of cymbal stands, or support brackets, which are attached to bass drums.

Because of the necessity of moving from one performance location to another, a drummer must very frequently set up his drum set, which often includes a number of different drums togethere with several cymbals. These cymbals are mounted to cymbal brackets secured to one of the drums, usually the bass drum, or to a separate cymbal stand.

The brackets and stand are formed with a free-threaded end on which the cymbal is loosely supported by steel washers, felt washers, and a wing nut. The central hole in the cymbal receives the free end of the stand, the free end being normally defined by what is known as a tilter rod, which allows the cymbal to be adjusted to various angular positons. When the cymbal is angularly disposed, a plastic sleeve is used around the threaded portion of the tilter rod to protect the threads and the hole of the cymbal from damage.

Because of the constant rocking and vibration of the cymbal, the plastic sleeve must be frequently replaced. Further, the wing nut, felt washer, and steel washer are repeatedly vibrated off the tilter rod and lost on stage or in the traveling case.

Very often, additional felt and steel washers must be placed on the tilter rod to allow the cymbal to be angularly displaced, and yet provide the cymbal with freedom of movement when struck. Because of the inherent restriction in supporting the cymbal to allow a true response when struck, the mounting devices used at present can not provide a positive angular displacement. That is, the cymbal must be very loosely supported, thus creating most of the above-mentioned problems.

Therefore, there is a tremendous need for the herein disclosed mounting device which solves all of the these problems.

SUMMARY OF THE INVENTION

In accordance with the present invention, a new and improved cymbal-mounting device is herein disclosed which provides for the mounting of a cymbal to a cymbal stand in a positive manner not accomplished heretofore. That is, once the cymbal is mounted to the stand by means of the improved mounting device, the cymbal is allowed to be simply snapped into place and tilted to any angular position desired, thus providing freedom of movement, without the binding of the stand shaft in the cymbal hole.

It is, therefore, an object of this invention to provide a new and improved cymbal holder or mount that does not require the use of a wing nut or other connecting members. The device is formed with a bushing mount, a flexible restraint member, and a cymbal keeper, allowing the cymbal to be snapped into a restraining position or unsnapped when the cymbal is to removed.

Another object of this invention is to provide a mounting device that allows complete freedom of movement for the cymbal, regardless of the angular disposition of the cymbal.

A further object of the invention is to provide an improved mounting device that includes a flexible restraint member that is formed from a coil spring having a geniculating action between the mounting bushing and the supporting bracket of the cymbal, whereby the cymbal is held in a positive manner by the keeper member and is allowed to rock through the support spring, without placing undue stress on the cymbal or the cymbal hole.

Still another object of the present invention is to provide a unique cymbal holder that holds the cymbal in a positive manner, but yet is arranged to permit the cymbal to vibrate when struck to propagate the resultant true resonant sound therefrom.

A still further object of this invention is to provide a device of this character that has relatively few operating parts, and that is inexpensive to manufacture.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the drawings, which are for illustrative purposes only.

DESCRIPTION OF THE PREFERRED EMBODIMENT

Figure 1:
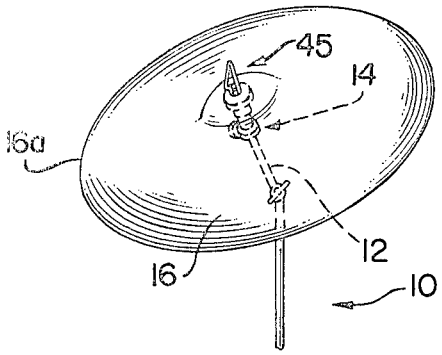
FIG. 1 is a perspective view of a cymbal mounted to a stand by means of the present invention.

Referring more particularly to the drawings, there is shown in FIG. 1 the upper portion of a typical cymbal stand, generally indicated at 10, having an adjustable tilter arm 12, the free end of which is adapted to receive and support the cymbal-mounting device, designated generally at 14. Accordingly, there is mounted to the device 14 a typical cymbal 16, which is shown to be angularly disposed.

Figure 6:
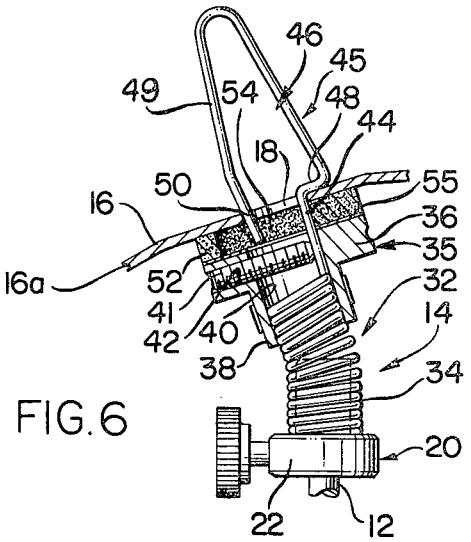
FIG. 6 is a side view of the present invention, showing the cymbal-supporting bracket in cross-section and the spring member deflected to one side.
Figure 3:
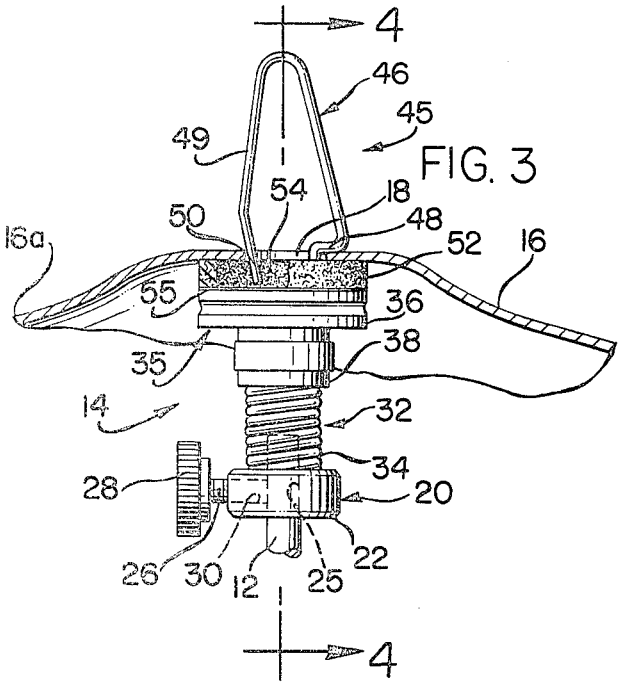
FIG. 3 is a side-elevational view of the mounting device, showing a portion of a cymbal supported thereon.

It is well understood that cymbals, such as 12, are provided with a central hole 18, as indicated in FIGS. 3 and 6, that provide a means for their attachment to a support structure.

Cymbal-mounting device 14 comprises a bushing mount 20, which defines a securing means by which mounting device 14 is attached to the free end of stand 10, which generally includes a tilter arm 12. Bushing mount 20 is formed with an enlarged head member 22 and an extended lug member 24, wherein there is disposed a central bore 25, the open end thereof being formed in head member 22.

As seen in FIG. 3, the free end of arm 12 is positioned within bore 25 and is secured therein by threaded pin 26 which includes a knob 28. Threaded pin 26 screws into the threaded bore 30 formed in head member 22 and engages arm 12. However, it should be understood that other various means for affixing bushing mount 20 to arm 12 are contemplated.

Figure 4:
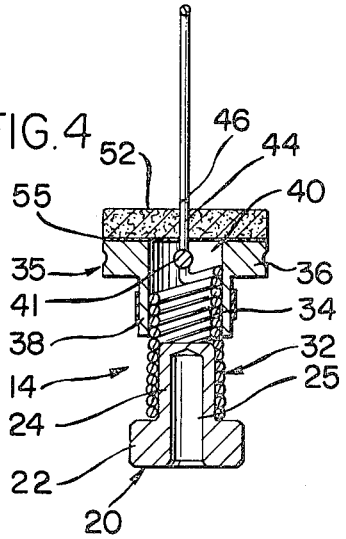
FIG. 4 is a cross-sectional view taken substantially along line 4—4 of FIG. 3.
Figure 5:
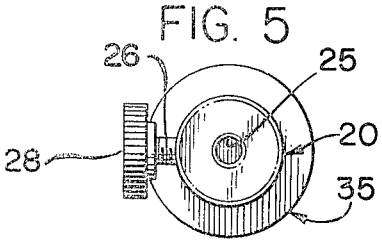
FIG. 5 is a bottom-plan view thereof.
Figure 2:
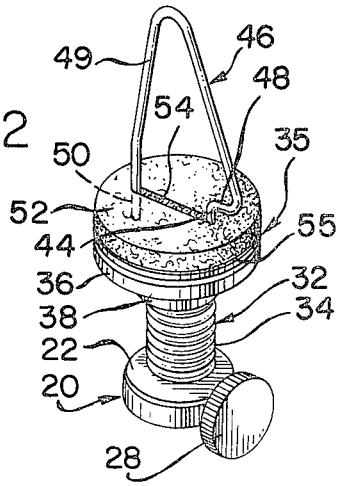
FIG. 2 is a perspective view of the new and improved cymbal-mounting device.

A flexible cymbal restraint means, indicated at 32, is attached to bushing mount 20, defining a support base. The restraint includes geniculating means comprising coil spring 34, defining a flexible connecting member. Lug 24 of bushing 20 is force-fitted within the lower portion of coil spring 34, as illustrated in FIG. 4. The upper portion of the coil spring is arranged to be received in and secured to a cymbal-support bracket 35 which is formed with an annular body member 36 having a depending neck member 38. An enlarged bore 40 passes respectively through both members 36 and 38.

Neck member 38 is positioned and secured over the upper coiled section of spring 34, thus allowing the spring to geniculate between the cymbal-support bracket 35 and the bushing mount 20, as indicated in FIG. 6. Means for securing the cymbal-support bracket 35 to spring 34 comprises a set screw 41 which is received in threaded bore 42 formed in annular body member 36, as seen in FIG. 6. Set screw 41 is arranged to engage the extended member 44 of coil spring 34. Thus, bracket 35 will move with the upper half of spring 34 when the spring is flexed or bent.

The extended member 44 extends further upwardly, thus projecting outwardly from bore 40 of bracket 35, whereby a releasable keeper means (designated at 45) is provided. The keeper means comprises the extended member 44 which is formed as a spring clip 46 having a shoulder 48 of a flexible arm 49. The clip 46 has a substantially triangular configuration, the apex thereof being rounded so as to be readily received through hole 18 of cymbal 16.

Since arm 49 terminates with a free end 50, it is allowed to flex or spring inwardly as the cymbal is moved downwardly thereover. Once the cymbal is moved beyond shoulder 48, it is held in place against a felt pad 52, and then locked into position between shoulder 48 of clip 46 and pad 52, and also the outward biasing force of arm 49.

This arrangement is unique with respect to attaching a cymbal of this character, because it not only holds it in place but allows the cymbal to vibrate without affecting the true resonant sound when struck. If the cymbal is struck with great force, spring 34 will geniculate—allowing the cymbal to be temporarily displaced without affecting the sound output. Accordingly, there is also no wear movement between the keeper means and the cymbal.

To release the cymbal from the keeper, one merely lifts the side of the cymbal 16*a* which faces biasing arm 49. This forces the cymbal to move and disengage shoulder 48, allowing the cymbal to pass over clip 46. It should be noted that pad 52 is provided with a lateral slot 54 to receive free end 40 of arm 49.

Means is provided to secure pad 52 to the surface of head 36. This means can be glue or an adhesive member, such as 55.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A cymbal-mounting device adapted to be attached to a cymbal stand and the like, wherein the device comprises:

a bushing mount defining a support base to be attached to a cymbal stand;

a flexible cymbal-restraint means secured to said bushing mount, wherein a cymbal is held in a substantially fixed position without affecting the resonant vibration of the cymbal when struck;

wherein said flexible cymbal restraint comprises:

a lower flexible tubular member adapted to be attached to said bushing mount; and a keeper member formed to releasably lock said cymbal to said device; and a cymbal-support bracket affixed to said flexible cymbal-restraint means, whereby said flexible cymbal-restraint means can geniculate at a point between said bushing mount and said support bracket.

2. A cymbal-mounting device as recited in claim 1, wherein said cymbal-support bracket includes a pad interposed between said support bracket and said cymbal, whereby said cymbal is locked between said keeper member and said pad.

3. A cymbal-mounting device as recited in claim 2, wherein said support bracket includes a securing means to secure said support bracket to said restraint means, whereby said support bracket and said cymbal will be angularly displaced when said lower flexible tubular member is geniculated.

4. A cymbal-mounting device as recited in claim 3, wherein said flexible tubular member is defined by a coil spring.

5. A cymbal-mounting device as recited in claim 4, wherein said keeper member extends upwardly and outwardly from said support bracket, defining a releasable spring clip arranged to be received in a central hole disposed in said cymbal.

6. A cymbal-mounting device as recited in claim 5, wherein said spring clip has a substantially triangular configuration comprising:

a first arm member extending outwardly from said support bracket;

a shoulder formed therein to engage said cymbal; and a second depending arm member defining a flexible biased arm for releasable engagement with said cymbal, whereby said cymbal can be snapped on and off said keeper member.

7. A cymbal-mounting device as recited in claim 1, including means for attaching said bushing mount to said cymbal stand.

8. A cymbal-mounting device adapted to be attached to a cymbal stand and the like, wherein the device comprises:

a bushing mount adapted to be attached to a cymbal stand;

geniculating means mounted to said bushing mount and extending outwardly therefrom;

a cymbal-support bracket attached to said geniculating means so as to move therewith; and a releasable keeper means secured to said support bracket and adapted to lock the cymbal to said device, in order to allow full resonant vibration of said cymbal when struck.

9. A cymbal-mounting device as recited in claim 8, wherein said releasable keeper means comprises a biasing clip adapted to be received in a central hole disposed in said cymbal, whereby the cymbal is placed over the clip and snapped into a locked positioned, and rests on said cymbal-support bracket.

10. A cymbal-mounting device as recited in claim 9, wherein said biasing clip comprises:

a first arm member extending upwardly and outwardly from said support brakcet, and attached thereto;

a shoulder formed in said first arm member adjacent said support bracket, for holding engagement with said cymbal;

a second arm formed from said first arm and depending angularly downward, thus defining a flexible biasing arm member for releasable engagement with said cymbal, whereby said cymbal can be snapped on and off said spring clip.

11. A cymbal-mounting device as recited in claim 10, wherein said supporting bracket includes a support pad interposed between said cymbal and said supporting bracket, and wherein said pad is provided with an aperture to receive said clip therethrough.

12. A cymbal-mounting device as recited in claim 11, wherein said geniculating means comprises a flexible member, the lower end thereof being secured to said bushing mount and the upper end thereof being secured to the support bracket, whereby said cymbal and said support bracket can be angularly displaced with respect to said bushing mount and said cymbal stand.

13. A cymbal-mounting device as recited in claim 12, wherein said flexible member is a coil spring.

* * * * *